US012426719B2

(12) United States Patent
de Leon et al.

(10) Patent No.: US 12,426,719 B2
(45) Date of Patent: Sep. 30, 2025

(54) PORTABLE CHANGING TABLE ASSEMBLY

(71) Applicants: Luis de Leon, West Valley, UT (US); Kelsey Kirkland, West Valley, UT (US)

(72) Inventors: Luis de Leon, West Valley, UT (US); Kelsey Kirkland, West Valley, UT (US)

( * ) Notice: Subject to any disclaimer, the term of this patent is extended or adjusted under 35 U.S.C. 154(b) by 275 days.

(21) Appl. No.: 18/144,662

(22) Filed: May 8, 2023

(65) Prior Publication Data

US 2024/0374048 A1 Nov. 14, 2024

(51) Int. Cl.
*A47D 5/00* (2006.01)
*A45F 4/06* (2006.01)

(52) U.S. Cl.
CPC ..... *A47D 5/006* (2013.01); *A45F 4/06* (2013.01)

(58) Field of Classification Search
CPC ..... A47D 5/006; A47D 15/003; A47D 13/02; A47D 13/027; A47D 5/00; A47D 15/00; A47D 5/003; A45F 3/04; A45F 4/02; A45F 4/06; A45C 13/103; A45C 13/1046; A45C 2013/1015; A45C 3/001
USPC ..... 5/655, 99.1, 190, 2, 108, 115, 224, 153, 5/416, 947; 224/153; 190/2; 108/115
See application file for complete search history.

(56) References Cited

U.S. PATENT DOCUMENTS

| | | | | |
|---|---|---|---|---|
| 5,694,860 | A | 12/1997 | Xiao | |
| 6,048,023 | A | 4/2000 | Lampton | |
| D598,671 | S | 8/2009 | Gagnon, Jr. | |
| 7,593,222 | B2 | 9/2009 | Zbikowski | |
| 2007/0039982 | A1 | 2/2007 | Carthern | |
| 2010/0108726 | A1 | 5/2010 | Hilgenberg | |
| 2012/0161408 | A1* | 6/2012 | Sidhu | A45C 13/28 280/47.38 |
| 2014/0166704 | A1 | 6/2014 | Perera | |
| 2020/0245781 | A1* | 8/2020 | Palacios | A45C 13/28 |

FOREIGN PATENT DOCUMENTS

| | | |
|---|---|---|
| WO | WO2020163651 | 8/2020 |

* cited by examiner

*Primary Examiner* — Justin C Mikowski
*Assistant Examiner* — Madison Emanski

(57) ABSTRACT

A portable changing table assembly for changing a diaper in a remote location includes a backpack, a swivel rotatably integrated into the backpack and a table that is attached to the swivel. The table is foldable into a stored position for carrying the table when the user wears the backpack. The table is unfoldable into a deployed position to facilitate an infant to be positioned on the table for changing the infant's diaper. A plurality of legs is each pivotally attached to the table. Each of the plurality of legs is positionable in a stored position or a deployed position to facilitate the table to support the weight of the infant.

9 Claims, 5 Drawing Sheets

PORTABLE CHANGING TABLE ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to changing table devices and more particularly pertains to a new changing table device for changing a diaper in a remote location. The device includes a backpack, a swivel attached to the backpack and a table attached to the swivel. The table is foldable into a stored position or a deployed position for supporting an infant. The device includes a plurality of legs pivotally attached to the table for supporting the table over a support surface when the table is in the deployed position.

(2) Description of Related Art Including Information Disclosed Under 37 CFR 1.97 and 1.98

The prior art relates to changing table devices including a backpack and a table pivotally integrated into the backpack which extends outwardly from the backpack when the table is deployed. The prior art discloses a portable laptop computer table that includes a computer bag and a laptop table that is extendable upwardly from the computer bag. The prior art discloses a portable table device that includes a backpack, a plurality of legs that are extendable downwardly from the backpack and a table that is pivotable outwardly from the backpack.

(h) BRIEF SUMMARY OF THE INVENTION

An embodiment of the disclosure meets the needs presented above by generally comprising a backpack, a swivel rotatably integrated into the backpack and a table that is attached to the swivel. The table is foldable into a stored position for carrying the table when the user wears the backpack. The table is unfoldable into a deployed position to facilitate an infant to be positioned on the table for changing the infant's diaper. A plurality of legs is each pivotally attached to the table. Each of the plurality of legs is positionable in a stored position or a deployed position to facilitate the table to support the weight of the infant.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
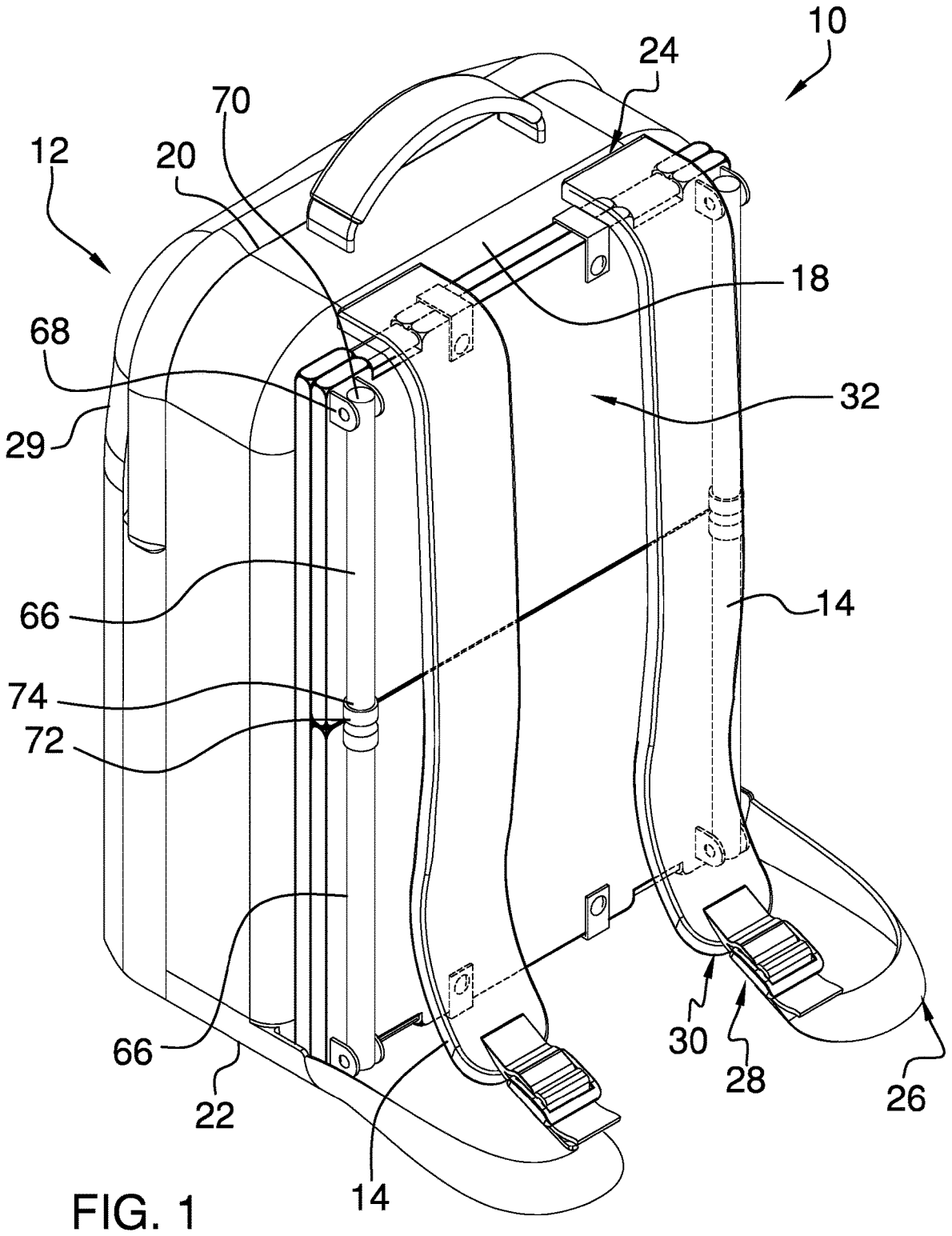
FIG. 1 is a front perspective view of a portable changing table assembly according to an embodiment of the disclosure.
Figure 2:
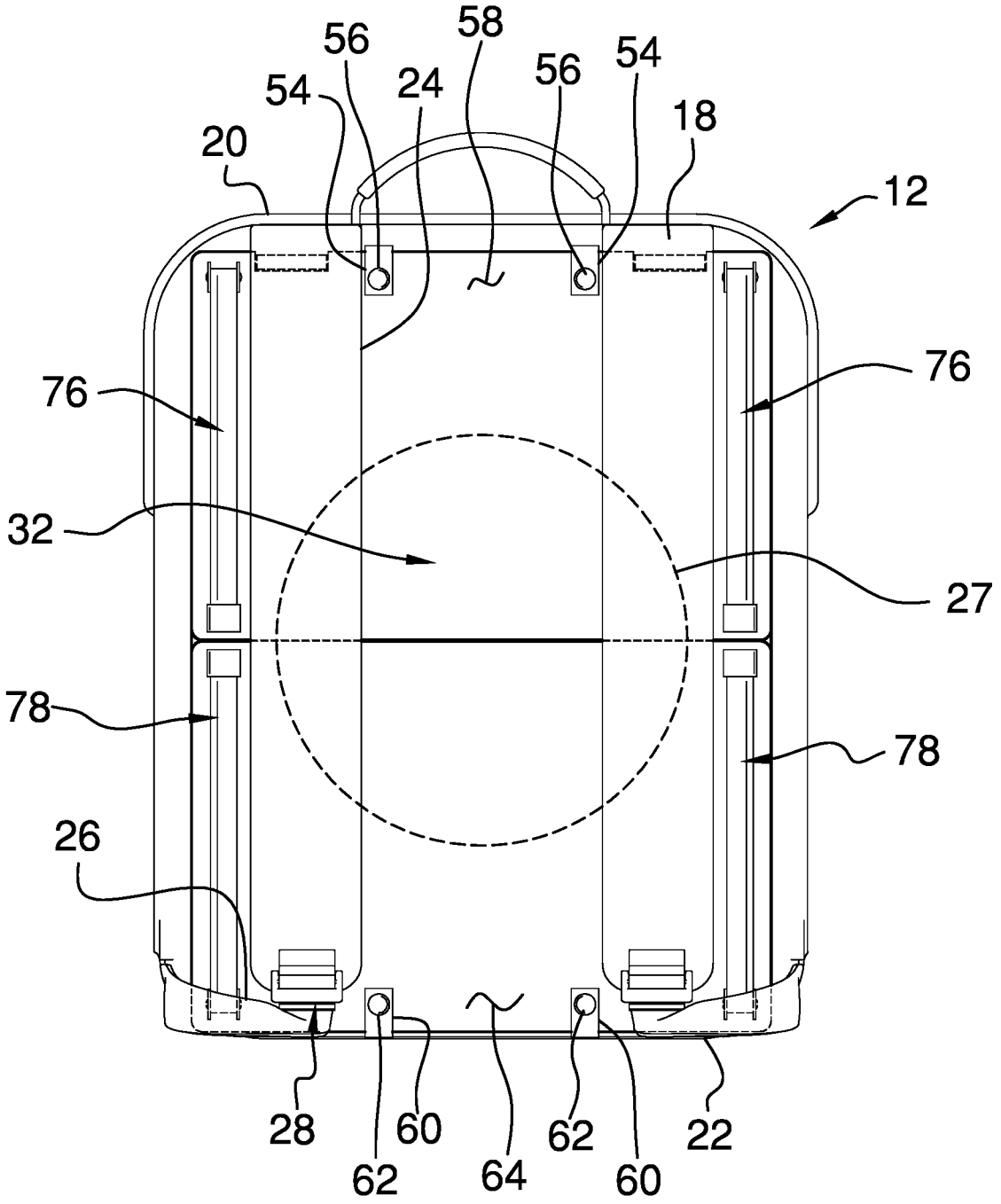
FIG. 2 is a front view of an embodiment of the disclosure.
Figure 3:
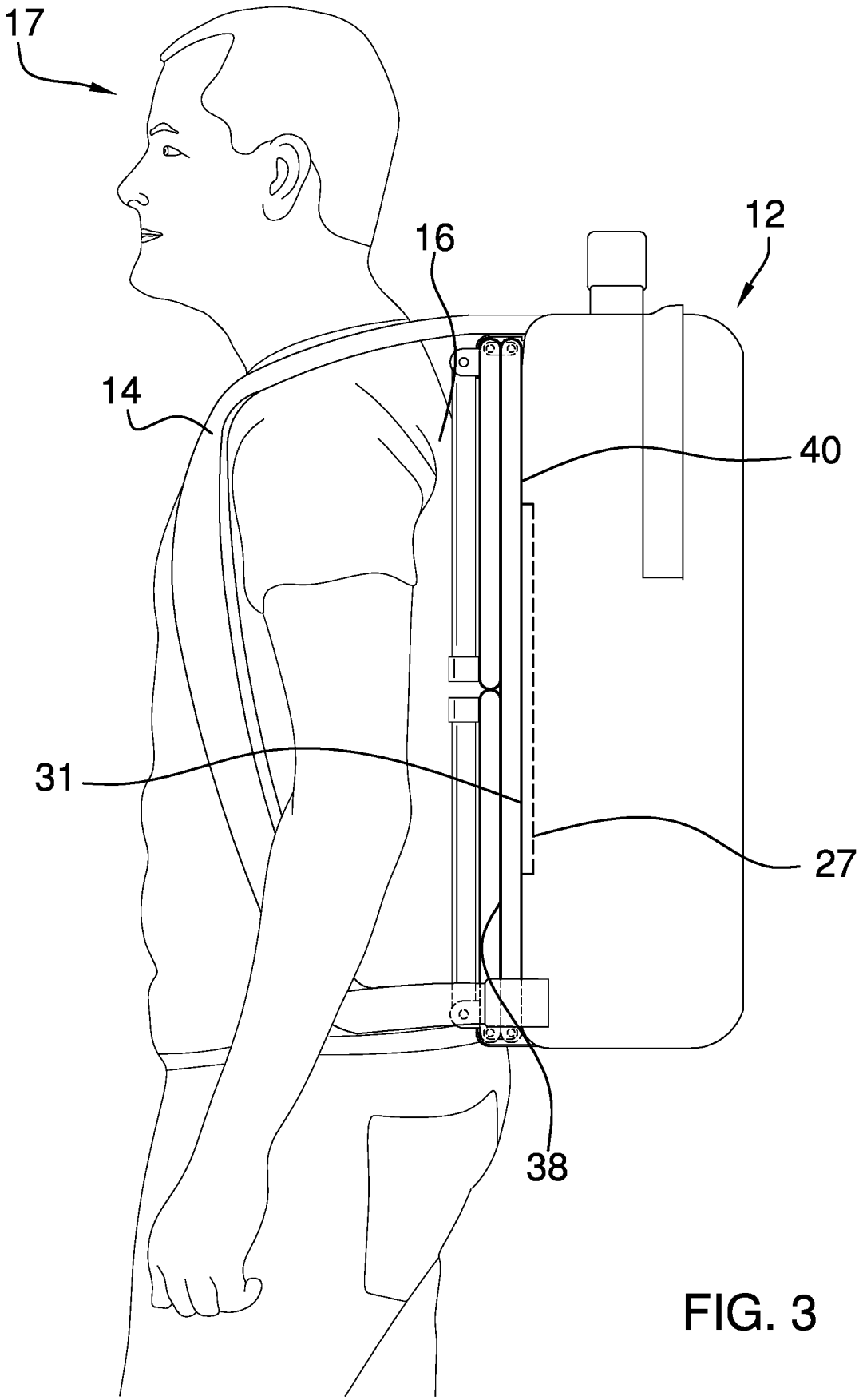
FIG. 3 is a left side view of an embodiment of the disclosure.
Figure 4:
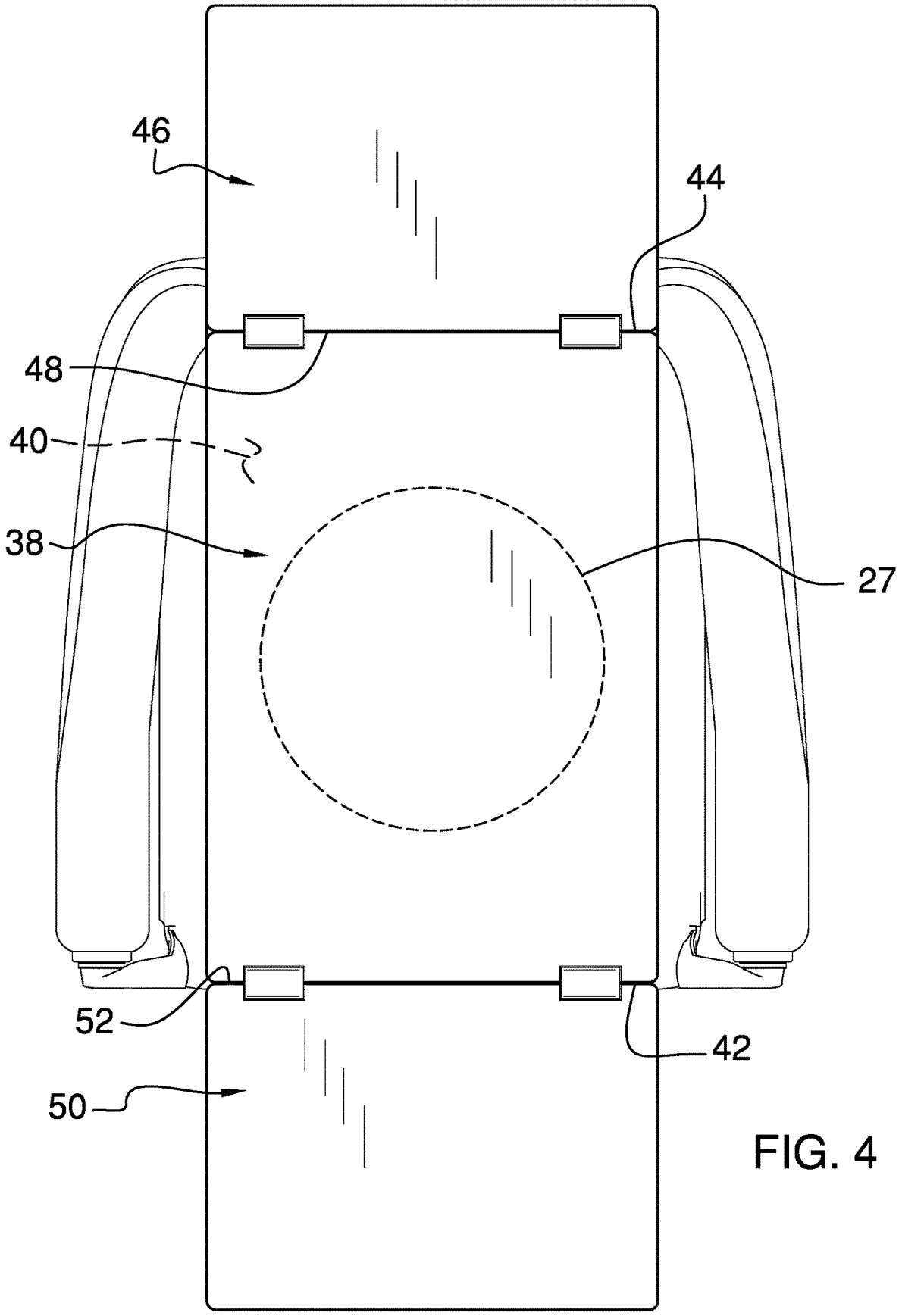
FIG. 4 is a front view of an embodiment of the disclosure showing a table in a deployed position.
Figure 5:
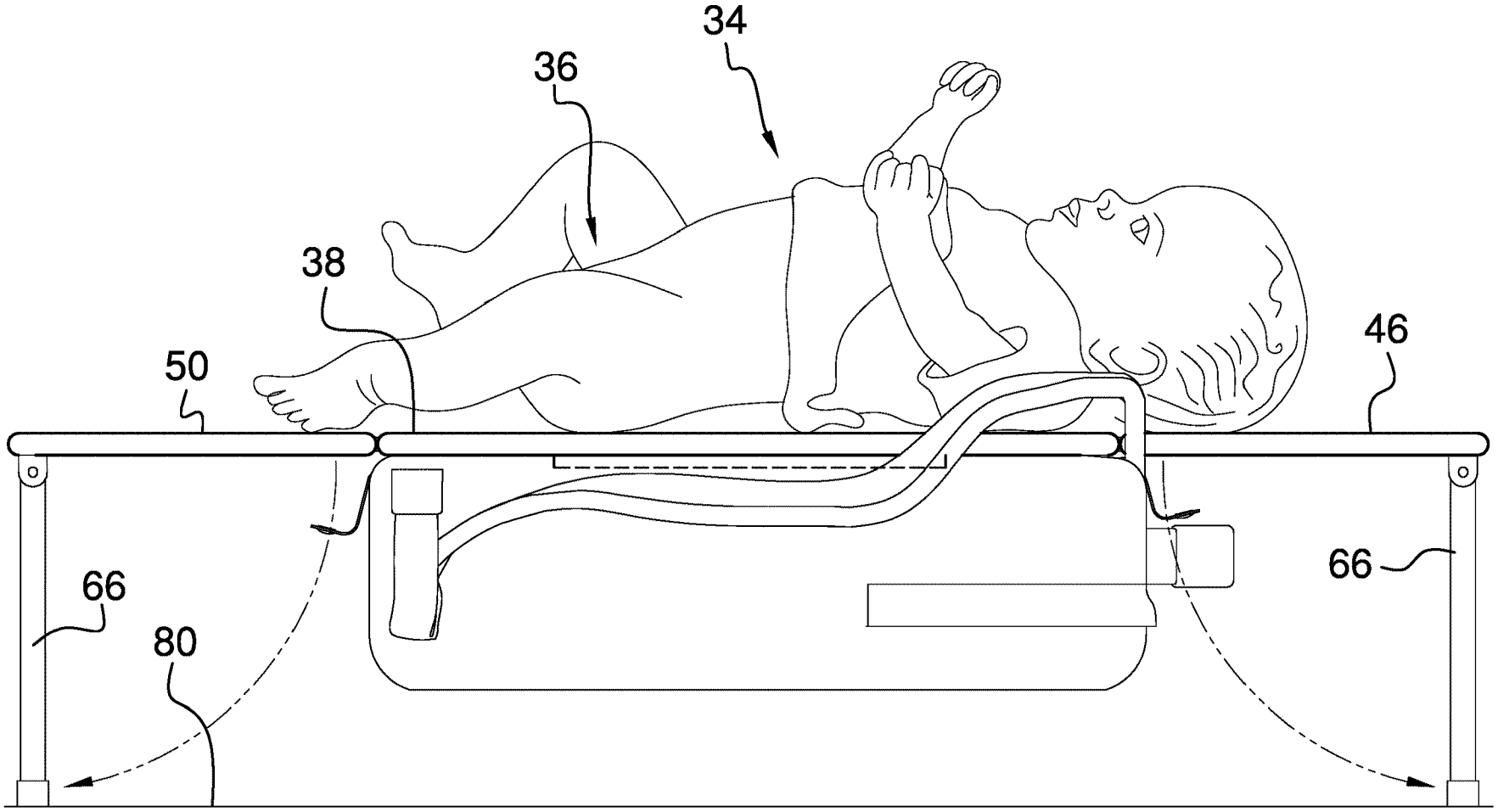
FIG. 5 is a perspective in-use view of an embodiment of the disclosure.

With reference now to the drawings, and in particular to FIGS. 1 through 5 thereof, a new changing table device embodying the principles and concepts of an embodiment of the disclosure and generally designated by the reference numeral 10 will be described.

As best illustrated in FIGS. 1 through 5, the portable changing table assembly 10 generally comprises a backpack 12 that has a pair of shoulder straps 14 which can be worn on a back 16 of a user 17 for carrying the backpack 12. The backpack 12 has a front side 18, a top side 20 and a bottom side 22 and each of the shoulder straps 14 comprises a first portion 24 that is coupled to the top side 20 and a second portion 26 that is coupled to the bottom side 22. Each of the shoulder straps 14 includes a buckle 28 that is disposed on a distal end 30 of the first portion 24. The second portion 26 of a respective one of the shoulder straps 14 is releasably attachable to the buckle 28 on first portion 24 of the respective shoulder strap 14. Furthermore, each of the shoulder straps 14 extends along the front side 18 of the backpack 12. A swivel 27 is rotatably integrated into the front side 18 of the backpack 12 and the swivel 27 is rotatable about an axis extending through the front side 18 and a back side 29 of the backpack 12. The swivel 27 has an exposed surface 31 with respect to the front side 18 and the swivel 27 may comprise a rotating disk, a pair of panels with a bearing between then or any other type of rotating mechanism.

A table 32 is attached to the swivel 27 and the table 32 is foldable into a stored position having the table 32 lying against the swivel 27 and the backpack 12. In this way the table 32 can be carried by the user 17 when the user 17 wears the backpack 12. The table 32 is unfoldable into a deployed position having the table 32 extending outwardly beyond the backpack 12. In this way the table 32 facilitates an infant 34 to be positioned on the table 32 for changing the infant's 34 diaper 36. Furthermore, the table 32 can be rotated on the swivel 27 to facilitate the table 32 to be rotated into a variety of orientations with the backpack 12. The table 32 comprises a first panel 38 that has a rear surface 40 which is bonded to the exposed surface 31 of the swivel 27. The first panel 38 has a lower edge 42 that is positioned proximate the bottom side 22 of the backpack 12 and the first panel 38 has an upper edge 44 that is positioned proximate the top side 20 of the backpack 12. The first panel 38 may have a length ranging between approximately 40.0 cm and 65.0 cm and a width ranging between approximately 20.0 cm and 30.0 cm.

The table 32 includes a second panel 46 that has a first edge 48 which is hingedly coupled to the upper edge 44 of the first panel 38. The second panel 46 lies against the first panel 38 when the second panel 46 is positioned in a folded position. Conversely, the second panel 46 extends away from the upper edge 44 having the second panel 46 lying on a plane that is oriented coplanar with the first panel 38 when the second panel 46 is positioned in an unfolded position. The table 32 includes a third panel 50 that has a primary edge 52 which is hingedly coupled to the lower edge 42 of the first panel 38. The third panel 50 lies against the first panel 38 when the third panel 50 is positioned in a folded position. Conversely, the third panel 50 extends away from the lower edge 42 having the third panel 50 lying on a plane that is oriented coplanar with the first panel 38 when the third panel 50 is positioned in an unfolded position. Each of the second panel 46 and the third panel 50 may have a length ranging between approximately 20.0 cm and 30.0. cm and a width ranging between approximately 20.0 cm and 30.0 cm.

The table 32 includes a pair of first straps 54 that is each attached to the upper edge 44 of the first panel 38. Each of the first straps 54 is matable 32 to a respective one of a pair of first engagements 56 that is disposed on a first surface 58 of the second panel 46 when the second panel 46 is in the folded position for retaining the second panel 46 in the folded position. Each of the first straps 54 is unmated from the respective first engagement 56 to facilitate the second panel 46 to be positioned in the unfolded position. The table 32 includes a pair of second straps 60 that is each attached to the lower edge 42 of the first panel 38. Each of the second straps 60 is matable 32 to a respective one of a pair of second engagements 62 that is disposed on a primary surface 64 of the third panel 50 when the third panel 50 is in the folded position for retaining the third panel 50 in the folded position. Additionally, each of the second straps 60 is unmated from the respective second engagement 62 to facilitate the third panel 50 to be positioned in the unfolded position.

A plurality of legs 66 is each pivotally attached to the table 32 and each of the plurality of legs 66 is positionable in a stored position having the plurality of legs 66 resting against the table 32. Each of the plurality of legs 66 is positionable in a deployed position having the plurality of legs 66 extending away from the table 32. In this way the plurality of legs 66 facilitate the table 32 to support the weight of the infant 34. Each of the plurality of legs 66 includes a pivot point 68 located adjacent to a first end 70 of the legs 66 and a foot 72 disposed on a second end 74 of the legs 66.

The plurality of legs 66 includes a set of first legs 76 and a set of second legs 78. The pivot point 68 associated with each of the first legs 76 is attached to the first surface 58 of the second panel 46. Additionally, the pivot point 68 associated with each of the first legs 76 is positioned adjacent to the first edge 48 of the second panel 46. Each of the first legs 76 lies against the first surface 58 of the second panel 46 when the first legs 76 are in the stored position. Conversely, each of the first legs 76 is oriented perpendicular to the first surface 58 of the second panel 46 when the first legs 76 are in the deployed position.

The pivot point 68 associated with each of the second legs 78 is attached to the primary surface 64 of the third panel 50. Additionally, the pivot point 68 associated with each of the second legs 78 is positioned adjacent to the primary edge 52 of the third panel 50. Each of the second legs 78 lies against the primary surface 64 of the third panel 50 when the second legs 78 are in the stored position. Conversely, each of the second legs 78 is oriented perpendicular to the primary surface 64 of the third panel 50 when the second legs 78 are in the deployed position. Furthermore, the table 32 may be attached to a duffel bag, a briefcase or other similar type of object that would be commonly carried by the user 17.

In use, the backpack 12 is worn on the user's back 16 when the user 17 will be caring for the infant 34 in a remote location, such as a public park for example, or other location that typically does not have restroom facilities. Each of the second panel 46 and the third panel 50 are positioned in the unfolded position and each of the plurality of legs 66 is positioned in the deployed position. In this way the legs 66 can support the table 32 above a support surface 80 thereby facilitating the infant 34 to be placed on the table 32 for changing the infant's 34 diaper 36. The table 32 can be rotated on the backpack if necessary to accommodate the user 17. Furthermore, supplies such as diapers, baby wipes and other supplies for changing diapers can be stored in the backpack 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A portable changing table assembly for facilitating changing a diaper of an infant in any location, said assembly comprising:

a backpack having a pair of shoulder straps wherein said backpack is configured to be worn on a back of a user for carrying said backpack, said backpack having a front side, a top side and a bottom side, each of said shoulder straps comprising a first portion being coupled to said top side and a second portion being coupled to said bottom side, each of said shoulder straps including a buckle being disposed on a distal end of said first portion, said second portion of a respective one of said shoulder straps being releasably attachable to said buckle on first portion of said respective shoulder strap, each of said shoulder straps extending along said front side of said backpack;

a swivel being rotatably integrated into said backpack, said swivel being positioned on said front side of said backpack, said swivel being rotatable about an axis extending through said front side and a back side of said backpack, said swivel having an exposed surface with respect to said front side;

a table being attached to said swivel, said table being foldable into a stored position having said table lying against said backpack wherein said table is configured to be carried by the user when the user wears said backpack, said table being unfoldable into a deployed position having said table extending outwardly beyond said backpack wherein said table is configured to facilitate the infant to be positioned on said table for changing the diaper of the infant; and a plurality of legs, each of said plurality of legs being pivotally attached to said table, each of said plurality of legs being positionable in a stored position having said plurality of legs resting against said table, each of said plurality of legs being positionable in a deployed position having said plurality of legs extending away from said table wherein said plurality of legs is configured to facilitate said table to support a weight of the infant.

2. The assembly according to claim 1, wherein said table comprises a first panel having a rear surface being bonded to said exposed surface of said swivel, said first panel having a lower edge being positioned proximate said bottom side of said backpack, said first panel having an upper edge being positioned proximate said top side of said backpack.

3. The assembly according to claim 2, wherein said table includes a second panel having a first edge being hingedly coupled to said upper edge of said first panel, said second panel lying against said first panel when said second panel is positioned in a folded position, said second panel extending away from said upper edge having said second panel lying on a plane being oriented coplanar with said first panel when said second panel is positioned in an unfolded position.

4. The assembly according to claim 3, wherein said table includes a third panel having a primary edge being hingedly coupled to said lower edge of said first panel, said third panel lying against said first panel when said third panel is positioned in a folded position, said third panel extending away from said lower edge having said third panel lying on a plane being oriented coplanar with said first panel when said third panel is positioned in an unfolded position.

5. The assembly according to claim 3, wherein said table includes a pair of first straps, each of said first straps being attached to said upper edge of said first panel, each of said first straps being matable to a respective one of a pair of first engagements being disposed on a first surface of said second panel when said second panel is in said folded position for retaining said second panel in said folded position, each of said first straps being unmated from said respective first engagement to facilitate said second panel to be positioned in said unfolded position.

6. The assembly according to claim 4, wherein said table includes:

a pair of first straps, each of said first straps being coupled to said first panel;

a pair of first engagements, each of said first engagements being coupled to said second panel; and a pair of second straps, each of said second straps being attached to said lower edge of said first panel, each of said second straps being matable to a respective one of a pair of second engagements being disposed on a primary surface of said third panel when said third panel is in said folded position for retaining said third panel in said folded position, each of said second straps being unmated from said respective second engagement to facilitate said third panel to be positioned in said unfolded position.

7. The assembly according to claim 3, wherein each of said plurality of legs includes a pivot point located adjacent to a first end of said legs and a foot disposed on a second end of said legs, said plurality of legs including a set of first legs and a set of second legs, said pivot point associated with each of said first legs being attached to a first surface of said second panel, said pivot point associated with each of said first legs being positioned adjacent to said first edge of said second panel, each of said first legs lying against said first surface of said second panel when said first legs are in a stored position, each of said first legs being oriented perpendicular to said first surface of said second panel when said first legs are in a deployed position.

8. The assembly according to claim 4, wherein each of said plurality of legs includes a pivot point located adjacent to a first end of said legs and a foot disposed on a second end of said legs, said plurality of legs including a set of first legs and a set of second legs, said pivot point associated with each of said second legs being attached to a primary surface of said third panel, said pivot point associated with each of said second legs being positioned adjacent to said primary edge of said third panel, each of said second legs lying against said primary surface of said third panel when said second legs are in a stored position, each of said second legs being oriented perpendicular to said primary surface of said third panel when said second legs are in a deployed position.

9. A portable changing table assembly for facilitating changing a diaper of an infant in any location, said assembly comprising:

a backpack having a pair of shoulder straps wherein said backpack is configured to be worn on a back of a user for carrying said backpack, said backpack having a front side, a top side and a bottom side, each of said shoulder straps comprising a first portion being coupled to said top side and a second portion being coupled to said bottom side, each of said shoulder straps including a buckle being disposed on a distal end of said first portion, said second portion of a respective one of said shoulder straps being releasably attachable to said buckle on first portion of said respective shoulder strap, each of said shoulder straps extending along said front side of said backpack;

a swivel being rotatably integrated into said backpack, said swivel being positioned on said front side of said backpack, said swivel being rotatable about an axis extending through said front side and a back side of said backpack, said swivel having an exposed surface with respect to said front side;

a table being attached to said swivel, said table being foldable into a stored position having said table lying against said backpack wherein said table is configured to be carried by the user when the user wears said backpack, said table being unfoldable into a deployed position having said table extending outwardly beyond said backpack wherein said table is configured to facilitate the infant to be positioned on said table for changing the diaper of the infant, said table comprising:

a first panel having a rear surface being bonded to said exposed surface of said swivel such that said first panel is rotatably retained on said backpack, said first panel having a lower edge being positioned proximate said bottom side of said backpack, said first panel having an upper edge being positioned proximate said top side of said backpack;

a second panel having a first edge being hingedly coupled to said upper edge of said first panel, said second panel lying against said first panel when said second panel is positioned in a folded position, said second panel extending away from said upper edge having said second panel lying on a plane being oriented coplanar with said first panel when said second panel is positioned in an unfolded position;

a third panel having a primary edge being hingedly coupled to said lower edge of said first panel, said third panel lying against said first panel when said third panel is positioned in a folded position, said third panel extending away from said lower edge having said third panel lying on a plane being oriented coplanar with said first panel when said third panel is positioned in an unfolded position;

a pair of first straps, each of said first straps being attached to said upper edge of said first panel, each of said first straps being matable to a respective one of a pair of first engagements being disposed on a first surface of said second panel when said second panel is in said folded position for retaining said second panel in said folded position, each of said first straps being unmated from said respective first engagement to facilitate said second panel to be positioned in said unfolded position; and a pair of second straps, each of said second straps being attached to said lower edge of said first panel, each of said second straps being matable to a respective one of a pair of second engagements being disposed on a primary surface of said third panel when said third panel is in said folded position for retaining said third panel in said folded position, each of said second straps being unmated from said respective second engagement to facilitate said third panel to be positioned in said unfolded position; and a plurality of legs, each of said plurality of legs being pivotally attached to said table, each of said plurality of legs being positionable in a stored position having said plurality of legs resting against said table, each of said plurality of legs being positionable in a deployed position having said plurality of legs extending away from said table wherein said plurality of legs is configured to facilitate said table to support a weight of the infant, each of said plurality of legs including a pivot point located adjacent to a first end of said legs and a foot disposed on a second end of said legs, said plurality of legs including a set of first legs and a set of second legs, said pivot point associated with each of said first legs being attached to said first surface of said second panel, said pivot point associated with each of said first legs being positioned adjacent to said first edge of said second panel, each of said first legs lying against said first surface of said second panel when said first legs are in a stored position, each of said first legs being oriented perpendicular to said first surface of said second panel when said first legs are in a deployed position, said pivot point associated with each of said second legs being attached to said primary surface of said third panel, said pivot point associated with each of said second legs being positioned adjacent to said primary edge of said third panel, each of said second legs lying against said primary surface of said third panel when said second legs are in a stored position, each of said second legs being oriented perpendicular to said primary surface of said third panel when said second legs are in a deployed position.

* * * * *